US009437923B2

(12) United States Patent
Gordon

(10) Patent No.: US 9,437,923 B2
(45) Date of Patent: Sep. 6, 2016

(54) SIMULTANEOUS IMAGING AND PRECISION ALIGNMENT OF TWO MILLIMETER WAVE ANTENNAS BASED ON POLARIZATION-SELECTIVE MACHINE VISION

(71) Applicant: Joshua A. Gordon, Boulder, CO (US)

(72) Inventor: Joshua A. Gordon, Boulder, CO (US)

(73) Assignee: The United States of America, as represented by the Secretary of Commerce, The National Institute of Standards and Technology, Washington, DC (US)

( * ) Notice: Subject to any disclaimer, the term of this patent is extended or adjusted under 35 U.S.C. 154(b) by 658 days.

(21) Appl. No.: 13/651,560

(22) Filed: Oct. 15, 2012

(65) Prior Publication Data

US 2014/0104104 A1 Apr. 17, 2014

(51) Int. Cl.

| | |
|---|---|
| ***H01Q 3/00*** | (2006.01) |
| ***H01Q 3/26*** | (2006.01) |
| ***H01Q 15/22*** | (2006.01) |
| ***H01Q 19/06*** | (2006.01) |
| ***H01Q 19/195*** | (2006.01) |
| *H01Q 1/12* | (2006.01) |
| *H01Q 3/08* | (2006.01) |

(52) U.S. Cl.

CPC ..... *H01Q 3/267* (2013.01); *H01Q 15/22* (2013.01); *H01Q 19/062* (2013.01); *H01Q 19/195* (2013.01); *H01Q 1/125* (2013.01); *H01Q 1/1257* (2013.01); *H01Q 3/08* (2013.01)

(58) Field of Classification Search

CPC ..... H01Q 1/125; H01Q 1/1237; H01Q 3/08; H01Q 3/267; H01Q 15/22; H01Q 19/062; H01Q 19/195

USPC ..... 342/359

See application file for complete search history.

(56) References Cited

U.S. PATENT DOCUMENTS

| | | | | |
|---|---|---|---|---|
| 5,659,318 | A * | 8/1997 | Madsen et al. | 342/25 C |
| 6,188,481 | B1 * | 2/2001 | Kumar | 356/489 |
| 6,342,870 | B1 | 1/2002 | Mehrkens et al. | |
| 6,611,696 | B2 | 8/2003 | Chedester et al. | |
| 6,618,144 | B1 * | 9/2003 | Reed | 356/343 |
| 7,412,175 | B2 * | 8/2008 | Chuss et al. | 398/204 |
| 7,501,982 | B2 | 3/2009 | Charash et al. | |
| 8,080,774 | B1 | 12/2011 | Guinn et al. | |
| 2006/0158734 | A1 * | 7/2006 | Schuurmans et al. | 359/485 |
| 2011/0122416 | A1 * | 5/2011 | Yang et al. | 356/457 |
| 2012/0075479 | A1 | 3/2012 | Uemura et al. | |

OTHER PUBLICATIONS

Cui et al., "Observation of polarization-gate based reconstruction quality improvement during the process of turbidity suppression by optical phase conjugation", Applied Physics Letters 95, 123702 (2009).*

Schuldt et al., "A heterodyne interferometer for high-perfomrance industrial metrology", Proc of SPIE, @2008.*

Ameya, M. et al., "W-band Antenna Gain Calibration in Extrapolation Range Using Time-Domain Gating," AMTA Proceedings, pp. 248-253, Nov. 2009, Salt Lake City, Utah.

Cimini, D. et al., "The Ground-Based Scanning Radiometer: A Powerful Tool for Study of the Arctic Atmosphere," IEEE Transactions on Geoscience and Remote Sensing, 2007) 45(9):2759-2777.

Dietlein, C. R. et al, "Absorption, transmission, and scattering of expanded polystyrene at millimeter-wave and terahertz frequencies," Proc. SPIE 6948, 69480E (2008), 9 pages.

Direen, R. H. et al., "Active Millimeter-Wave Imaging: Detection of Concealed Weapons," AMTA Proceedings, pp. 287-289, Oct. 2010, Atlanta, Georgia.

Proctor, T., "An Approach to Antenna Range Alignment Utilizing a Laser Tracking System," AMTA Proceedings, pp. 324-329, Oct. 2010, Atlanta, Georgia.

Repjar, A. G. et al., "Extrapolation Range Measurements for Determining Antenna Gain and Polarization," NBS Tech Note 1311, Aug. 1987, 92 pages.

Sekelsky, S. M. et al., "Parallax Errors and Corrections for Dual-Antenna Millimeter-Wave Cloud Radars," Journal of Atmospheric and Oceanic Technology (2002) 19:478-485.

Wittmann, R. C. et al., "Spherical Near-Field Scanning: Experimental and Theoretical Studies," NISTIR 3955, Jul. 1990, 121 pages.

Wittmann, R. C. et al., "Near-Field Antenna Measurements Using Nonideal Measurement Locations," IEEE Transactions on Antennas and Propagation (1998) 46(5):716-722.

Yaghjian, A. D., "Near-Field Antenna Measurements on a Cylindrical Surface: A Source Scattering-Matrix Formulation," NBS Tech Note 696, Sep. 1977, 44 Pages.

Yaghjian, A. D., "An Overview of Near-Field Antenna Measurements," IEEE Transactions on Antennas and Propagation (1986) AP-34(1):30-45.

* cited by examiner

*Primary Examiner* — Frank J McGue

(74) *Attorney, Agent, or Firm* — Kevin Soules; Kermit D. Lopez; Luis M. Ortiz

(57) ABSTRACT

A system and method for imaging and aligning antennas that includes an overlay imaging aligner composed of two or more antennas in association with a polarization gate, a polarization beam splitter, a non-polarizing beam splitter, a beam dump, one or more imaging lens and a common detector array. The overlay imaging aligner aligns the antennas by overlaying simultaneous digital images associated with the antennas on the common detector array. The antennas can be, for example, mm Wave antennas, waveguides, etc. The detector array generates real-time digital images the antennas. Such an approach of simultaneous imaging leverages the spatial resolution of digital optical imaging to aligning antenna components.

20 Claims, 4 Drawing Sheets

SIMULTANEOUS IMAGING AND PRECISION ALIGNMENT OF TWO MILLIMETER WAVE ANTENNAS BASED ON POLARIZATION-SELECTIVE MACHINE VISION

TECHNICAL FIELD

Embodiments are related to millimeter wave antennas. Embodiments are also related to techniques, devices and systems for aligning millimeter wave antennas. Embodiments are additionally related to polarization-selective machine vision elements and the simultaneous imaging and precise alignment of millimeter wave antennas.

BACKGROUND OF THE INVENTION

In recent years an increasing number of systems have been developed in the mm-wave and terahertz frequency ranges. At these high frequencies (e.g., 50-500 GHz), wavelengths can approach sub-millimeter dimensions. With such wavelength scales, the mechanical alignment of waveguide and antenna components becomes increasingly difficult. Antenna characterization techniques, such as those used in extrapolation measurements, near field measurements, and general spatial antenna characterization require the precise positioning of antenna components.

At these frequencies, new techniques must be developed for achieving the same alignment tolerances that have been traditionally straightforward to achieve in the MHz and lower GHz regimes. Although other alignment approaches using laser tracking systems have been previously proposed, a new approach is disclosed herein including a compact optical alignment tool that utilizes polarization-selective optical elements and imaging optics to simultaneously capture and align, in real-time, two digital images of the components that are to be aligned along a common axis to within sub-wavelength precision and accuracy.

BRIEF SUMMARY

The following summary is provided to facilitate an understanding of some of the innovative features unique to the disclosed embodiment and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for a method and system for simultaneous imaging and precise alignment of at least two mm Wave antennas.

It is another aspect of the disclosed embodiments to provide for a method and system of aligning antennas utilizing a polarization-selective machine vision approach.

It is yet another aspect of the disclosed embodiments to provide for an OIA (Overlay Imaging Aligner) to aid in the alignment of antenna components.

It still another aspect of the disclosed embodiments to provide for a method and system of simultaneous imaging that leverages the spatial resolution of digital optical imaging to aligning antenna components.

The aforementioned aspects and other objectives and advantages can now be achieved as described herein. A system and method is disclosed for imaging and aligning antennas. An example embodiment can include an overlay imaging aligner composed of two or more antennas in association with a polarization gate, a polarization beam splitter, a non-polarizing beam splitter, a beam dump, one or more imaging lens and a common detector array. The overlay imaging aligner aligns the two or more antennas by overlaying simultaneous digital images associated with the antennas on the common detector array. The antennas can be, for example, mm-Wave antennas, waveguides, etc. The detector array generates real-time digital images of the antennas. Such an approach of simultaneous imaging leverages the spatial resolution of digital optical imaging for aligning antenna components.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete and will fully convey the scope of the invention to those skilled in the art. Unnecessary detail of known functions and operations may be omitted from the current description so as not to obscure the present invention. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Many situations call for the alignment of two antennas or waveguiding components along a common axis, as in the case of extrapolation range measurements, or relative to a baseline coordinate system as in planar, cylindrical and spherical near-field scanning. Compared to the mm-wave and low THz frequency regimes, the alignment process at lower frequencies is aided by the fact that the wavelength can be large compared to the mechanical apparatus used to manipulate and orient the antenna components. At the mm-wave and THz frequencies, the wavelength approaches mm to sub-mm dimensions. The resulting mechanical tolerances and position accuracy of mounts and alignment stages must be significantly better than half a wavelength, depending on accuracy measurements; i.e., tens to hundreds of microns. By applying mechanical designs and techniques used in optical systems, where the wavelength is on the order of hundreds of nanometers, many of these obstacles can be addressed.

Figure 1:
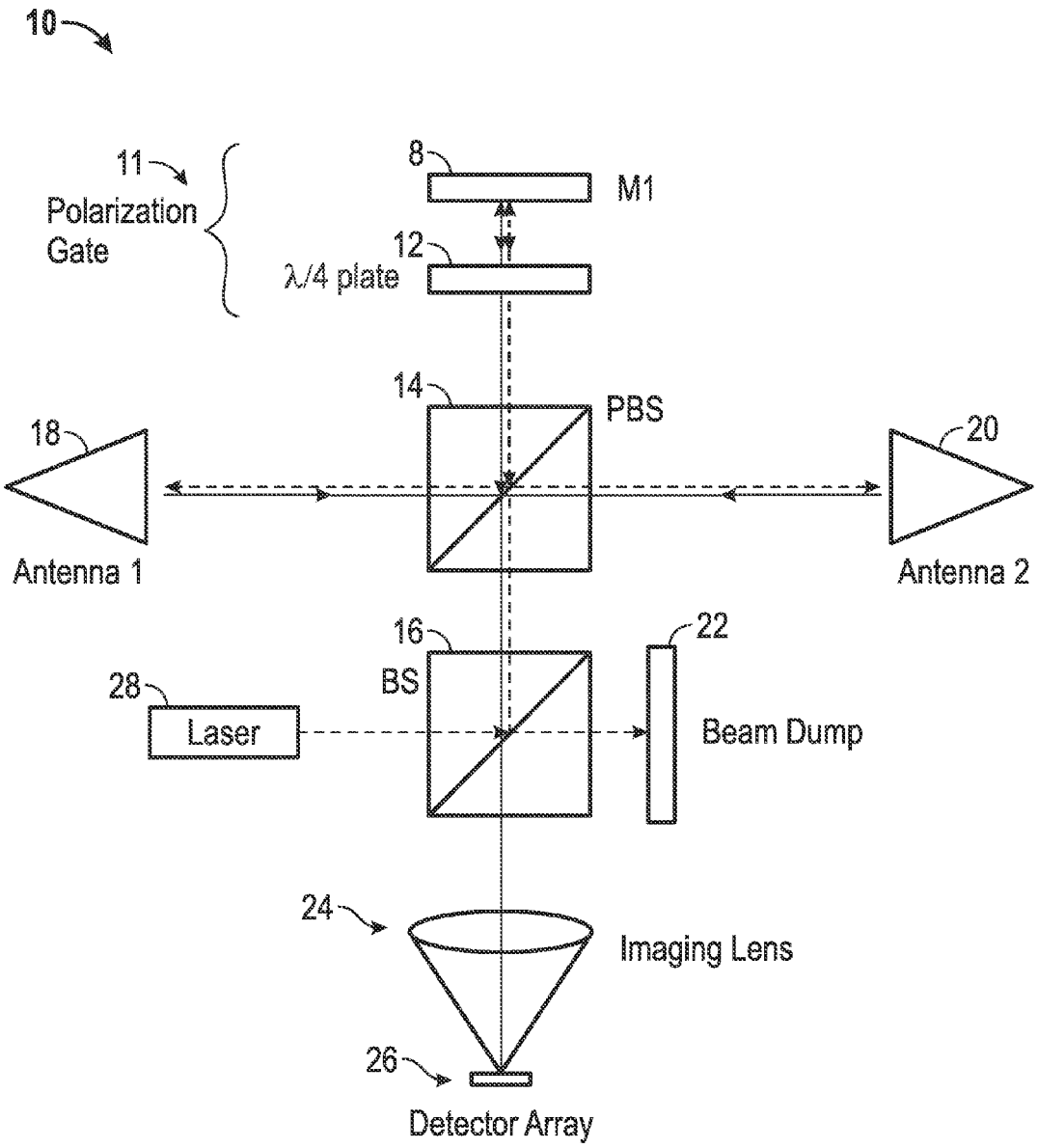
FIG. 1 illustrates a block diagram of an OIA (Overlay Imaging Aligner) system, in accordance with the disclosed embodiments.

FIG. 1 illustrates a block diagram of OIA (Overlay Imaging Aligner) system 10, in accordance with the disclosed embodiments. Note that the OIA system 10 can also be referred to simply as the "OIA 10". The system 10 generally includes a polarization gate 11 composed of a retro-reflecting mirror 8 (also referred to as "M1" in FIG. 1) and a λ/4 plate 12. System 10 further includes a PBS (Polarization Beam Splitter) 14 (e.g. a PBS cube) with respect to two waveguide or antenna components: a first antenna 18 and a second antenna 20. System 10 also includes a laser 28 with respect to a non-polarizing beam splitter (BS) 16 and a beam dump 22. System 10 further includes at least one imaging lens 24 and a detector array 26.

The OIA system 10 can be implemented based on a polarization-selective machine vision approach to address alignment issues. The OIA system 10 can provide real-time alignment of two waveguide or antenna components such as the respective first and second antennas 18 and 20, as well as mm-wave focusing and beam-shaping optics along a common axis, by overlaying simultaneous digital images of both components on the common imaging detector array 26.

The real-time simultaneous imaging of the two antenna 18 and 20 can be accomplished by generating two polarized images from the (assumed) unpolarized scene of the ambient or actively illuminated antennas. The unpolarized light from each of the antennas 18, 20 can be separated into two orthogonal linear polarized states via the polarization beam splitter cube (PBS) 14. Both of these orthogonally polarized images can be reflected by the PBS 14. The image from the second antenna 20, for example, can be directed into the imaging lens 24 and the detector array 26.

To combine both images, the polarization gate made from the broadband quarter-wave plate 12 oriented at 45° to the plane of polarization of the PBS 14 and the retro-reflecting mirror 8 can be utilized to rotate the polarization state of the image from the first antenna 18 by 90°. The image from the first antenna 18 is then able to transmit through the PBS 14 and combine with the reflected image from the second antenna 20 at the PBS 14, thereby producing an overlaid image of both antennas. The combined image can be then relayed to the detector array 26 via the focus-adjustable imaging lens 24. The detector array 26 can provide real-time digital images of the antenna components alignment and can be processed in software for highly accurate and precise antenna component alignment at the pixel level.

In some embodiments, a compact low power (e.g., <5 mW) laser diode operating at, for example, 635 nm wavelength, can provide an alignment beam that is injected into the optical path via the non-polarizing beam splitter cube 16. Such a beam can server several functions. First, the beam can be utilized as a visual reference for coarse alignment of both antenna components to the center of the field of view (FOV) of both imaging channels. Second, the beam can be also be used to aid in aligning the elevation and azimuth of antenna components and setups by observing its back reflection off reflecting reference surfaces such as waveguide flanges and reference mirrors.

The system 10 can be designed in some example embodiments with an approximate FOV of, for example, 10 cm×10 cm suitable imaging and aligning mm-wave antenna components. In such an example scenario, the working distance may be 300 mm from the center of the PBS 14 to the flange or the plane of interest of the antenna component. All optics used in such an example particular case may possess, for example, 25 mm clear apertures. The focal length of the imaging lens 24 used in such a case may be, for example, 35 mm, which provides a nominal working magnification from antenna-to-detector of m≈−0.1. In such an example scenario, the detector or detector array 26 can be provided in the form of a monochrome 1280×1024 CMOS array with a 5.2 um pixel size. It can be appreciated, of course, that these various values and sizes represent merely one potential example embodiment, and that many variations are possible.

The precision of the antenna alignment attainable is generally dictated by the pixel size and the camera lens focal length, whereas the accuracy of the image overlap from each image channel of the OIA system 10 can be dictated by the error in the angle of the mirror 8 (i.e., "M1") to normal incidence and wedge errors in the facets and beam splitting interface of the PBS 14.

The use of an image array allows for sub-wavelength transverse alignment precision in the mm-wave regime. The precision in the transverse direction, Δx at the antenna is calculated by, $$\Delta x = \frac{\Delta x_p}{m},$$

where, $\Delta x_p$ is the pixel size and in is the image magnification defined from the antenna to the detector. In a prototype embodiment of the OIA system 10, for example, Δx=52 μm which at an operating frequency of 300 GHz, can provide a precision of approximately λ/20.

Low PBS wedge errors and proper alignment of mirror 8 are critical for high accuracy alignment performance of the OIA system 10. Manufacture specified tolerances for the PBS 14 used in the aforementioned prototype embodiment may be within ±5 arc seconds. The mirror 8 can be set in some embodiments, in an adjustable and lockable kinematic optics mount so that it can be aligned normal the surface of the PBS 14 to ensure proper overlay of the two image channels. The mirror 8 may also be integrated into a monolithic realization of the polarization gate 11 that would combine the mirror 8 the quarter wave plate 12 and the polarization beam splitter 14 into one robust unit that would be more impervious to alignment drifts. It can be appreciated that many techniques are available for aligning optical surfaces. The alignment of the OIA optical components are discussed next.

In order for the OIA system 10 to provide accurate alignment of antennas, the optical axes of both Channels 1 and 2 must be collinear. It is therefore critical that the normal of mirror 8 and the normal to the face of the PBS 14 be accurately aligned. This is assuming the fabrication tolerances of the PBS 14 are sufficient enough so that any wedge errors between the faces of the PBS 14 and the 45° beam splitting interface can be neglected.

The transverse alignment error at the antenna, $\epsilon_x$ as a function of mirror tilt error, $\Delta\theta$ (for small $\Delta\theta$) can be calculated as follows:

$$\varepsilon_x = \frac{\varepsilon_{xp}}{m} = 2\Delta\theta[(m-1)f/m - l] \tag{1}$$

where $\epsilon_{xp}$ is the image shift at the pixel array, f is the focal length of the imaging lens, in is the working magnification, and l is the length from the front principal plane of the camera lens to M1 or mirror 8.

Figure 2:
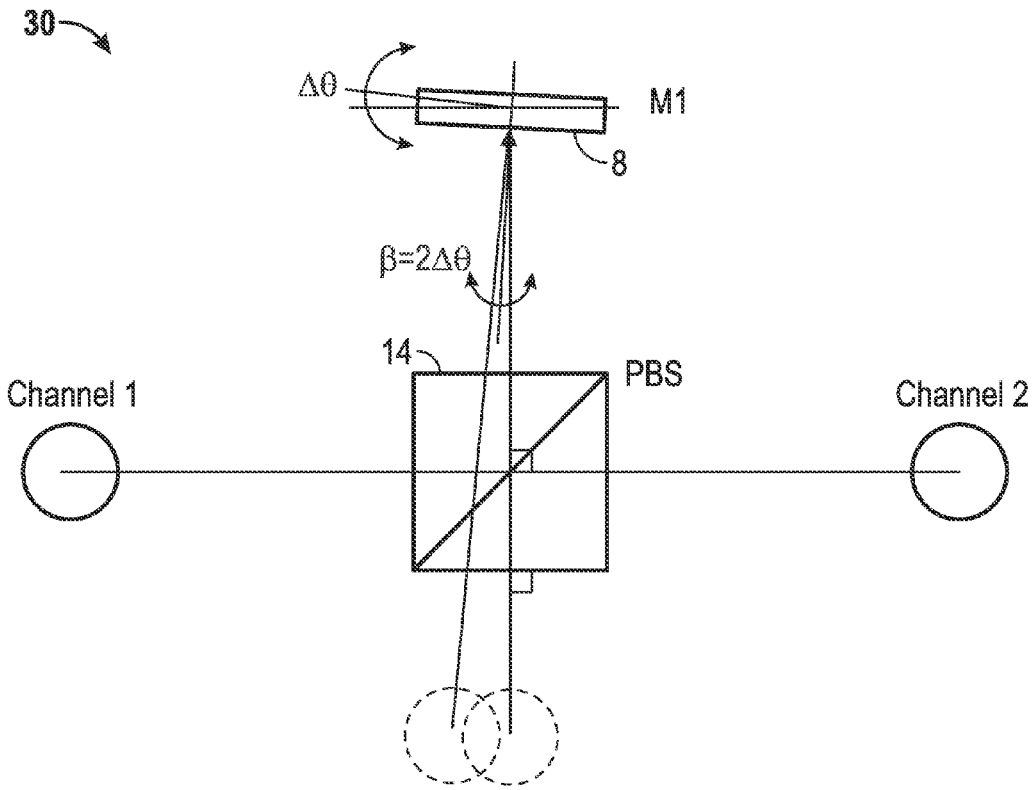
FIG. 2 illustrates a schematic diagram of a configuration depicting the image shift resulting from tilt errors in mirror, in accordance with the disclosed embodiments.

FIG. 2 illustrates a schematic diagram of a configuration 30 depicting the image shift resulting from tilt errors in mirror 8, in accordance with the disclosed embodiments. The schematic diagram of FIG. 2 indicates how the tilt error $\Delta\theta$ of mirror 8 results in a registration error of the images from Channel 1 and Channel 2. The quarter wave plate 12 and the non-polarizing beam splitter (BS) 16 are not shown in FIG. 2 for clarity. Alignment of a prototype OIA system 10 can be achieved utilizing, for example, a theodolite in auto-collimation mode. In such a scenario, a corner cube can be employed to retro reflect the beam exiting the theodolite that is formed by the internally illuminated reticle of the theodolite.

The beam exiting the theodolite and the retro reflected beam can form two counter propagating and co-linear beams which can form a reference optical axis used to align the two image channels 1 and 2 of the OIA 10. The path of the counter propagating beams may be such that the beam exiting the theodolite enters the PBS 14 at Channel 1 and the retro reflected beam enters at Channel 2. With the theodolite focused on the reticle image produced by the corner cube, the retro-reflected beam can be first aligned to the internal theodolite reticle. This can be accomplished by adjusting the translation at the corner cube so that the retro-reflected reticle image overlaps with the internal reticle in the theodolite.

Next, the PBS 14 can be set in place with its normal face aligned to the retro-reflected beam axis. This step or operation can be accomplished by observing the image of the reticle through the PBS 14 with the theodolite, while the orientation of the PBS 14 is adjusted so that the internal reticle and the reflected reticle overlap.

Next, the mirror 8 can be put in place and aligned. The PBS 14 can reflect 50% of the unpolarized reticle beam exiting the theodolite toward mirror 8 thereby creating two reflected reticle images (i.e., from mirror 8 and from the corner cube). This second image of the reticle can be observed as mirror 8 is adjusted so that the three reticle images generated by, 1) the corner cube, 2) mirror 8 and 3) the internal reticle are simultaneously overlapped. The quarter wave plate 12 can be then installed to ensure that its position does not distort the alignment of the beam path as defined by the alignment of mirror 8 to the PBS 14. At this point the two image channel optical axes are aligned and relay overlapping images from Channel 1 and Channel 2 to the imaging lens 24 and the detector array 26. The overlap of these two images will be to within an error consistent with (1) for the specified angular error achievable with the theodolite, $\Delta\theta$.

After aligning the mirror 8 and the PBS 14, the internal laser can be confidently aligned so that that it produces two sections of a laser beam which are 180° apart and of equal power, exiting from both channels in opposite directions, and emanating from the same point. This pseudo continuous laser beam can be then employed for quick coarse visual alignment of antenna components.

Figure 3:
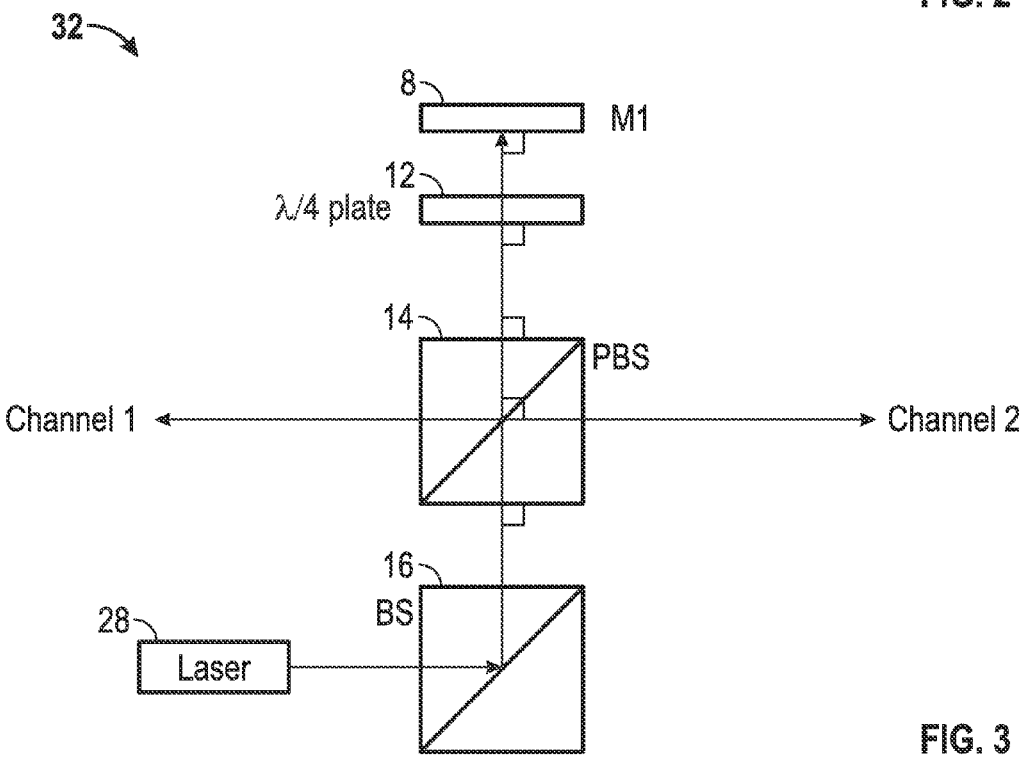
FIG. 3 illustrates a schematic diagram depicting a configuration including the beam path and alignment of the internal diode laser, in accordance with the disclosed embodiments.

FIG. 3 illustrates a schematic diagram depicting a configuration 32 including the beam path and alignment of the internal diode laser, in accordance with the disclosed embodiments. For aligning the laser, the OIA 10 can be kept in the same positing after aligning the mirror 8 and the corner cube. The laser diode can be rotated so that its polarization orientation provides equal power between the outputs of the PBS 14. The quarter wave plate 12 can be then adjusted so that the laser beam exiting Channels 1 and 2 are equal. The laser diode position can be then adjusted using the kinematic mount it was supported in so that the laser beam roughly exits the center of the ports for both image channels.

Two beams results, which exit the camera/lens port, one created by the retro-reflection off the corner cube, and one by the front surface of the PBS 14, and can be used to align the laser diode. The position of the laser diode can be adjusted so that these two retro-reflected beams as observed out of the camera/lens port overall over several meters. At this point the laser beams can exit the center of the image ports for Channels 1 and 2 as indicated in FIG. 3. Since the laser beam is primarily used as a visual reference, the deviation from 180° between these two sections of the laser beam is not as critical as the alignment of the PBS 14, mirror 8, and the quarter wave plate 12.

One example of antenna component alignment can involve horn antenna alignment. In a horn antenna embodiment, for example, two WR-03 horns can be aligned to the same axis with the OIA. First the horns can be removed from the waveguide feeds. The waveguide apertures can be then aligned to the laser and the horns re-connected to the waveguides. At this point both horns appear in the FOV of the OIA image. Precision alignment of the horn apertures can be then achieved by optimizing the overlap in the image by adjusting the horn position. One can align the waveguide apertures as well as horn apertures using the OIA which can be helpful in determining any discrepancies in horn-to-waveguide alignment that may be useful in characterizing the antenna system.

The transverse alignment perpendicular to the OIA optical axis and rotation of the antenna components about this axis can be read directly from the pixel array data. A realistic alignment error determined from pixel data is on the order of approximately 50 μm-100 μm of microns taking into account the pixel FOV of 52 μm and image contrast effects which confuse the boundaries of the antenna components in the image. Pixel alignment error between images can be quantified by employing image software in real time video and/or image files can be saved for further analysis.

The azimuth and elevation of antenna components can be aligned using several methods. A course alignment method useful for visual assessment of azimuth and elevation alignment involves observing the reflected laser beam back reflection off the flanges of the antenna components. A more accurate method involves aligning several different planes of the antenna components to the same axis using the OIA images. This may be accomplished by decreasing the image depth-of-field by decreasing the F-stop of the lens, so that only selective planes along the axis of the antenna components are in focus. For example, simultaneous alignment of the planes containing the throat and aperture of a horn antenna provides a means for minimizing azimuth and elevation errors between the two horn antennas.

For increased azimuth and elevation measurement capability the OIA camera and imaging lens can be replaced with an autocollimator or theodolite. In such an embodiment, instead of producing an image, the OIA optics can relay the two image channels to the autocollimator or theodolite for high precision azimuth and elevation alignment of reference mirrors or reflecting surfaces. In some embodiments, the OIA can include an integrated laser reticle that allows for auto-collimation capability for high precision azimuth and elevation alignment with arc-second or better accuracy.

In general, the azimuth and elevation alignment of horn antennas can be achieved by aligning multiple planes of the horns of the same axis. The imaging capability of the OIA allows for many features on the antenna components other than aperture planes to be used for alignment such as flanges and precision alignment pins which allow for the alignment of non-identical antennas. Because the OIA is compatible with optical tables and mounting hardware, it can be easily mated to opto-mechanical components for repeatable kinematic alignment setups, independent of antenna mounting hardware. This assists in addressing issues that arise from not being able to rely on registering alignment of antenna mounting components for alignment purposes.

In another example embodiment, the OIA can be used to align the axes of, for example, two WR-2.2 horns and two TPX lenses. In such a configuration, the lens-to-lens spacing can be 500 mm and the lens-to-horn spacing may be 50 mm. The OIA can be centered between two sets of horns and lenses by observing the image size of the antennas thus ensuring equal horn-to-OIA path lengths. To quantify the alignment accuracy, the signal level over the 325-500 GHz band can be obtained with the OIA alignment and can be compared to the signal level achieved via an electrical alignment.

The two horns can be aligned to each other using the OIA in the same manner as described previously. The laser beam can be then utilized to coarsely center the TPX lenses along the axis of the horns. Because TPX is optically clear, the transmitted laser beam as well as residual front and back surface reflections can be observed inside the lenses. The position of the lenses can be adjusted to center and minimize the transmitted laser beam path deviation through the lenses, as well as align the front and back lens surface reflections so that they are co-linear with the transmitted beam.

Figure 4:
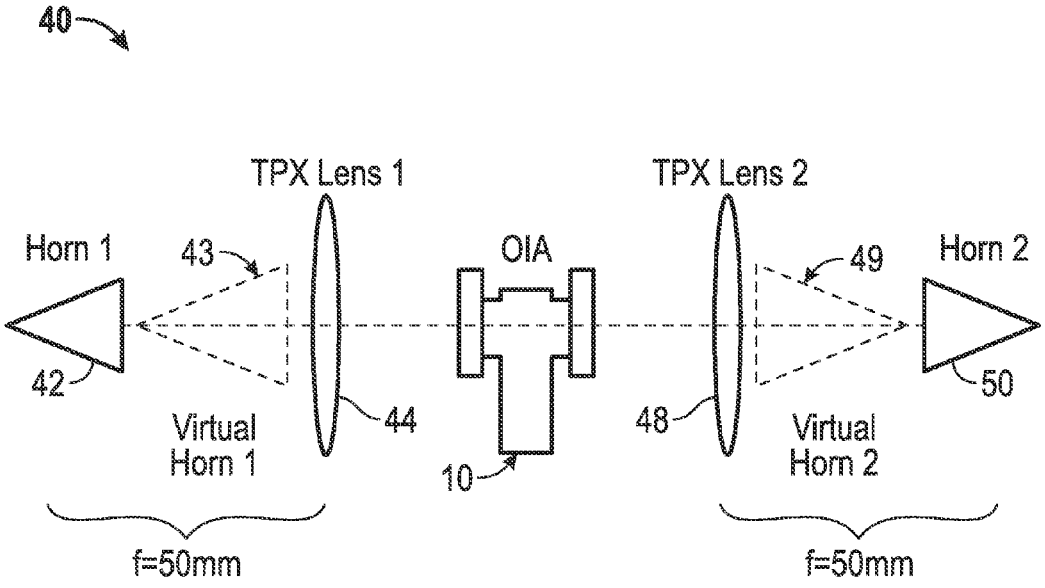
FIG. 4 illustrates a schematic diagram of a system depicting first and second "virtual horns" produced by respective TPX lenses with respect to "real" horns in accordance with the disclosed embodiments.

FIG. 4 illustrates a schematic diagram of a system 40 depicting first and second "virtual horns" 43 and 49 (dotted outline) produced by respective TPX lenses 44, 48 with respect to "real" horns 42, 50 in accordance with the disclosed embodiments. System 40 thus includes "real" horns 42, 50 with respect to lenses 44 and 48 and the OIA 10. Note that the final alignment of the lenses to the horn axes can be accomplished by imaging the horns through the TPX lenses using the OIA 10. The optical clarity of the TPX lenses 44, 48 allows the OIA 10 to image through them.

Many scenarios call for using collimating mm-wave optics with horns as in this particular scenario. Under the collimating condition, the horn phase center is at the focal length of the collimating mm-wave lens, and therefore the horn aperture is typically near or inside the lens focal length. In addition the focal length of the TPX lens at optical frequencies is nearly the same as at mm-wave frequencies. Therefore the TPX lenses can act as magnifying glasses and produce magnified "virtual" images of the horn apertures. The production of such virtual images by the TPX lenses 44, 48 is shown in the configuration of FIG. 4. These virtual horn images act as virtual objects for the OIA optics, i.e., these "virtual horns" can be re-imaged by the OIA optics. Any misalignment of the lenses axes relative to the horn axes will be manifested as the appearance of these virtual horns being misaligned. Note that the virtual images are in fact "located" behind the actual horns but in practice appear closer since they are magnified.

It is then a matter of aligning these virtual horns by adjusting the TPX lenses and not the actual horns 42, 50. This allows for direct simultaneous and accurate alignment of both lenses to both horns along the same axis by observing the position and overlap of these "virtual horns" in the digital images.

To quantify the alignment accuracy achieved with the OIA, a comparison to an electrical alignment can be made. After performing the alignment of horns and lenses with the OIA, the transmit horn can be translated perpendicular to the horn propagation axis to attempt to further optimize the power out of the receive horn. The translation of the transmit horn can be made in, for example, 10 μm steps over a range of +/−200 μm. The 0 μm reference position can be defined by the position of the transmit horn that had been determined by the original alignment using only the OIA. The movement of the horn relative to the 0 μm position needed to peak the power out of the receiver can provide a measurement of how far off of peaked electrical alignment the OIA achieves.

Figure 5:
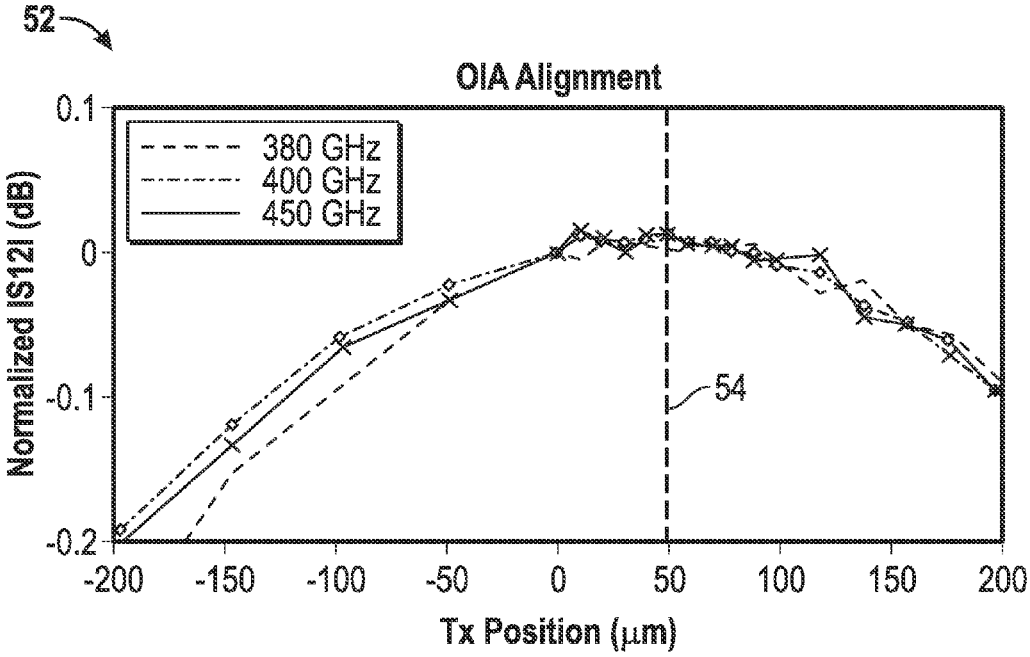
FIG. 5 illustrates a graph that plots data for frequencies, 380 GHz, 400 GHz, and 450 GHz where the value of |S12| has been normalized by the |S12| value obtained with the OIA alignment at the 0 μm position, in accordance with the disclosed embodiments.

FIG. 5 illustrates a graph 52 that plots data for frequencies, 380 GHz, 400 GHz, and 450 GHz where the value of $|S12|$ has been normalized by the $|S12|$ value obtained with the OIA alignment at the 0 μm position, in accordance with the disclosed embodiments. It can be appreciated that the data shown in graph 52 represents experimental data, and that many variations are possible. Graph 52 is provided to demonstrate merely example data, and is not a limiting feature of the disclosed embodiments. In general, the vertical dotted line 54 shown in FIG. 5 indicates the position of peak receive power as the transmit horn is moved around the alignment position determined by the OIA. These data show extremely good alignment accuracy obtained with the OIA, with errors in the relative peak electrical alignment transmitted power $\ll 0.1$ dB and discernible antenna position errors of, $\Delta x \approx 50$ μm which in terms of wavelength is $\lambda/16$, $\lambda/15$, $\lambda/13$ at 380 GHz, 400 GHz, and 450 GHz, respectively.

Figure 6:
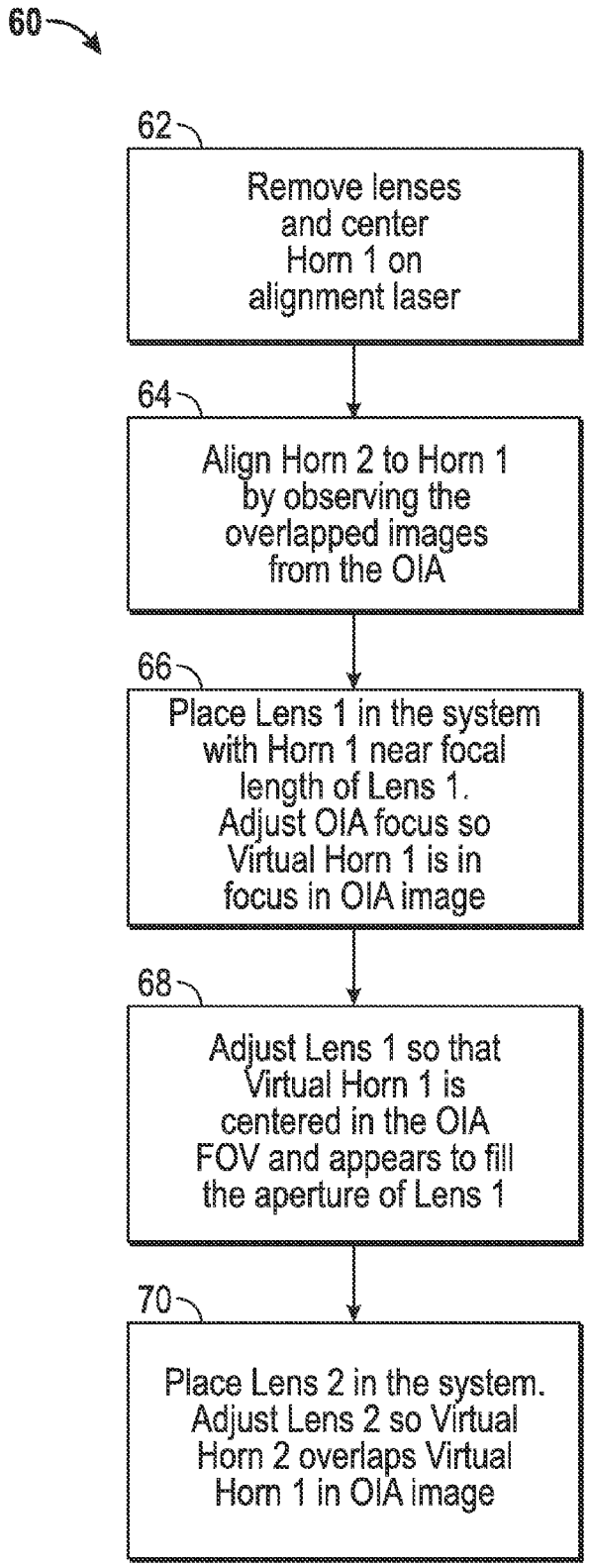
FIG. 6 illustrates a high-level flow chart of operations depicting logical operational steps of a method for virtual horn alignment, in accordance with the disclosed embodiments.

FIG. 6 illustrates a high-level flow chart of operations depicting logical operational steps of a method 60 for virtual horn alignment, in accordance with the disclosed embodiments. As indicated in block 62, a step or logical operation can be implemented in which the lenses are removed and a first horn (e.g., horn 42 of FIG. 4) is centered with respect to an alignment laser (e.g, laser 28 of FIG. 1). Next, as depicted at block 64, a step or logical operation can be implemented in which a second horn (e.g., horn 50 shown in FIG. 4) is aligned to the first horn by observing the overlapped images from the OIA 10.

Thereafter, as shown at block 66, a step or logical operation can be implemented in which the first lens (e.g, TPX lens 44) is placed in the system (e.g., system 40 of FIG. 4) with the first horn near the focal length of the first lens. The OIA focus can be adjusted so that the first "virtual horn" (e.g., virtual horn 43) is in focus in the OIA image. Following implementation of the operation indicated at block 66, a step or logical operation can be implemented as described at block 68 in which the first lens is adjusted so that the first virtual horn is centered in the FOV of the OIA 10 and appears to fill the aperture of the first lens.

Finally, as illustrated at block 70, a step or logical operation can be implemented in which the second lens (e.g., TPX lens 48 of FIG. 4) is placed in the system 40, and the second lens is adjusted to that the second virtual horn (e.g, virtual horn 49 of FIG. 4) overlaps the first virtual horn in the OIA image.

It can be appreciated that in some embodiments, the addition of an integrated laser reticle may allow the OIA to be used in an auto-collimation mode in addition to the transverse image alignment mode discussed herein. Auto-collimation capability can improve the angular sensitivity and accuracy of the current OIA design by allowing for simultaneously aligning the azimuth and elevation of two antennas using a reference mirror to arc-second or better accuracy.

Based on the foregoing, it can be appreciated that a number of embodiments, preferred and alternative, are disclosed herein. For example, in one embodiment, a system can be implemented for imaging and aligning antennas. Such a system can include an overlay imaging aligner that includes two or more antennas in association with a polarization gate, a polarization beam splitter, a non-polarizing beam splitter, a beam dump, one or more imaging lens and a common detector array. In such a system, the overlay imaging aligner can align the antennas by overlaying simultaneous digital images associated with the antennas on the common detector array.

In another embodiment, the common detector array can be implemented as an imaging detector array. In still another embodiment, the aforementioned antennas can be provided as mm Wave antennas. In yet other embodiments, such antennas may constitute waveguides. In another embodiment, the imaging detector array can generate real-time digital images of the at least two antennas. In yet another embodiment, two or more horns can be provided in association with the lenses and the overlay imaging aligner, such that the lenses produce magnified images of respective apertures of the horns to generate "virtual" horn images for use in aligning the lenses to the horns.

In another embodiment, a method for imaging and aligning antennas can be provided. Such a method can include, for example, steps or logical operations for configuring an overlay imaging aligner to include two or more antennas in association with a polarization gate, a polarization beam splitter, a non-polarizing beam splitter, a beam dump, one or more imaging lens and a common detector array, and aligning the antennas via the overlay imaging aligner by overlaying simultaneous digital images associated with the antennas on the common detector array by leveraging the spatial resolution of the digital optical images to aligning antenna components associated with the antennas. In other embodiments, steps or logical operations can be provided for associating at least two horns with the lenses and the overlay imaging aligner, and aligning the lenses to the horns by employing the lenses to produce images of respective apertures of the horns to generate virtual horn images for use in the aligning of the lenses to the horns.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art, which are also intended to be encompassed by the following claims.

What is claimed is:

1. A system for imaging and aligning antennas, said system comprising:

an overlay imaging aligner comprising:

at least two antennas forming a straight line beam path with a polarization beam splitter therebetween;

a polarization gate arranged perpendicularly to said straight line beam path;

a non-polarizing beam splitter aligned with said polarization gate on an opposite side of said polarization beam splitter along a perpendicular straight line beam path;

a beam dump and an alignment beam arranged on opposite sides of said non-polarizing beam splitter; and at least one imaging lens and a common detector array aligned along said perpendicular straight line beam path, wherein said overlay imaging aligner aligns said at least two antennas by overlaying simultaneous digital images associated with said at least two antennas on said common detector array.

2. The system of claim 1 wherein said common detector array comprises an imaging detector array.

3. The system of claim 2 wherein said imaging detector array generates real-time digital images of said at least two antennas.

4. The system of claim 1 wherein said at least two antennas comprise mm-Wave antennas.

5. The system of claim 4 wherein said imaging detector array generates real-time digital images of said at least two antennas.

6. The system of claim 1 wherein said at least two antennas comprise waveguides.

7. The system of claim 1 further comprising at least two horns forming a beam path with said at least two lenses and said overlay imaging aligner, wherein said at least two lenses produce magnified images of respective apertures of said at least two horns to generate virtual horn images for use in aligning said at least two lenses to said at least two horns.

8. An apparatus for imaging and aligning antennas, said apparatus comprising:

at least two antennas forming a straight line beam path with a polarization beam splitter therebetween;

a polarization gate comprising a retro-reflecting mirror and a quarter plate, arranged perpendicularly to said straight line beam path;

a non-polarizing beam splitter aligned with said polarization gate on an opposite side of said polarization beam splitter along a perpendicular straight line beam path;

a beam dump and an alignment beam arranged on opposite sides of said non-polarizing beam splitter; and at least one imaging lens and an imaging detector array, wherein said overlay imaging aligner aligns said at least two antennas by overlaying simultaneous digital images associated with said at least two antennas on said imaging detector array.

9. The apparatus of claim 8 wherein said at least two antennas comprise mm Wave antennas.

10. The apparatus of claim 9 wherein said imaging detector array generates real-time digital images of said at least two antennas.

11. The apparatus of claim 9 further comprising at least two horns forming a beam path with said at least two lenses and said overlay imaging aligner, wherein said at least two lenses produce magnified images of respective apertures of said at least two horns to generate virtual horn images for use in aligning said at least two lenses to said at least two horns.

12. The apparatus of claim 8 wherein said at least two antennas comprise waveguides.

13. The apparatus of claim 8 wherein said imaging detector array generates real-time digital images of said at least two antennas.

14. The apparatus of claim 8 further comprising at least two horns forming a beam path with said at least two lenses and said overlay imaging aligner, wherein said at least two lenses produce magnified images of respective apertures of said at least two horns to generate virtual horn images for use in aligning said at least two lenses to said at least two horns.

15. A method for imaging and aligning antennas, said method comprising:

configuring an overlay imaging aligner to include at least two antennas forming a straight line beam path with a polarization beam splitter therebetween, a polarization gate arranged perpendicularly to said straight line beam path, a non-polarizing beam splitter aligned with said polarization gate on an opposite side of said polarization beam splitter along a perpendicular straight line beam path, a beam dump and an alignment beam arranged on opposite side of said non-polarizing beam splitter, and at least one imaging lens and a common detector array; and aligning said at least two antennas via said overlay imaging aligner by overlaying simultaneous digital images associated with said at least two antennas on said common detector array by leveraging a spatial resolution of said digital optical images to align antenna components associated with said at least two antennas.

16. The method of claim 15 wherein said common detector array comprises an imaging detector array.

17. The method of claim 16 wherein said imaging detector array generates real-time digital images of said at least two antennas.

18. The method of claim 15 wherein said at least two antennas comprise mm Wave antennas.

19. The method of claim 15 wherein said at least two antennas comprise waveguides.

20. The method of claim 15 further comprising:

including in said beam path at least two horns with said at least two lenses and said overlay imaging aligner; and aligning said at least two lenses to said at least two horns by employing said at least two lenses to produce images of respective apertures of said at least two horns to generate virtual horn images for use in said aligning of said at least two lenses to said at least two horns.

* * * * *